US008117996B2

(12) United States Patent
Oda

(10) Patent No.: US 8,117,996 B2
(45) Date of Patent: Feb. 21, 2012

(54) WATER HEATER

(75) Inventor: Hiroshi Oda, Nagoya (JP)

(73) Assignee: Paloma Industries, Limited, Nagoya-Shi (JP)

( * ) Notice: Subject to any disclaimer, the term of this patent is extended or adjusted under 35 U.S.C. 154(b) by 302 days.

(21) Appl. No.: 12/107,982

(22) Filed: Apr. 23, 2008

(65) Prior Publication Data

US 2008/0264356 A1 Oct. 30, 2008

(30) Foreign Application Priority Data

Apr. 27, 2007 (JP) ..... 2007-119827

(51) Int. Cl.
*F24H 1/24* (2006.01)

(52) U.S. Cl. ..... 122/18.3; 122/18.1; 122/32; 122/14.31; 122/13.01; 122/14.2

(58) Field of Classification Search ..... 122/18.1, 122/32, 14.31, 14.2, 13.01
See application file for complete search history.

(56) References Cited

U.S. PATENT DOCUMENTS

| | | | | |
|---|---|---|---|---|
| 1,531,348 | A | 3/1925 | Richardson | |
| 1,706,416 | A | 3/1929 | Schwartz | |
| 2,479,042 | A * | 8/1949 | Gaines | 122/17.1 |
| 2,684,054 | A | 7/1954 | Carson | |
| 2,814,278 | A | 11/1957 | Cameron | |
| 5,022,352 | A * | 6/1991 | Osborne et al. | 122/17.2 |
| 5,085,579 | A * | 2/1992 | Moore et al. | 431/326 |
| 5,427,525 | A * | 6/1995 | Shukla et al. | 431/350 |
| 6,561,138 | B2 | 5/2003 | Kobayashi et al. | |
| 6,895,902 | B2 | 5/2005 | Kobayashi et al. | |
| 2005/0172915 | A1 * | 8/2005 | O'Donnell et al. | 122/17.1 |

FOREIGN PATENT DOCUMENTS

| | | |
|---|---|---|
| FR | 652023 | 3/1929 |
| GB | 1 461 522 | 1/1977 |
| JP | 2001-304691 A1 | 10/2001 |

OTHER PUBLICATIONS

Australian Office Action dated Sep. 20, 2011.

* cited by examiner

*Primary Examiner* — Steven B McAllister
*Assistant Examiner* — Seth Greenia
(74) *Attorney, Agent, or Firm* — Burr & Brown

(57) ABSTRACT

A water heater capable of suppressing an increase in the combustion air temperature exiting the heater and the generation of nitrogen oxide within an easy structure is provided. In the water heater, a burner is provided in a combustion chamber which is below a hot water storage chamber that is an all primary air burner which takes in the air required for gas combustion, whereby the air is mostly primary air. In addition, the burner is provided with a supporting plate in the combustion chamber at a height that allows part of the burner head to be protruded into a space covered by a lower mirror plate.

6 Claims, 2 Drawing Sheets

WATER HEATER

BACKGROUND OF THE INVENTION

This application claims the entire benefit of Japanese Patent Application Number 2007-119827 filed on Apr. 27, 2007, the entirety of which is incorporated by reference.

FIELD OF THE INVENTION

The present invention relates to a water heater, especially a hot water storage type water heater, for heating hot water stored in a hot water storage chamber to a predetermined temperature and keeping the temperature.

DESCRIPTION OF THE BACKGROUND ART

As shown in patent document 1, a hot water storage type water heater including a hot water storage chamber on the upper side of a cylindrical main body and a combustion chamber has been known. The hot water storage chamber is formed on an upper side of the cylindrical main body by closing top and bottom thereof with a mirror plate formed with an upward protruded restriction part in the upper and lower directions and has an exhaust passage at a central axis thereof. The combustion chamber with a burner is located on a lower side of the hot water storage chamber. FIG. 4 illustrates a lower portion of such a hot water storage type water heater 30 including a hot water storage chamber 31, a lower mirror plate 32, and a combustion chamber 33. When a burner 34 is combusted in the combustion chamber 33 and high temperature combustion gas goes up in an exhaust passage 35, hot water in the hot water storage chamber 31 is heated and kept at a predetermined temperature. Numeral 37 donates an air inlet for taking in combustion air, the inlet being drilled around a lower part of a stand 36 on which the burner 34 is set and being communicated with.

Patent document 1: Japanese Unexamined Patent Publication No. 2001-304691

SUMMARY OF THE INVENTION

The conventional burner 34 described in the patent document is a Bunsen burner, and a large combustion space is needed in the combustion chamber 33. Thus, a distance between the burner 34 and the lower mirror plate 32 is long, and radiation heat from the burner 34 is emitted toward an inner surface of the combustion chamber 33 as illustrated with wavy lines. Thus, the radiation heat is not efficiently transmitted to the lower mirror plate 32. When a temperature of combustion air from the air inlet 37 is increased by such radiation heat, a volume of the air is expanded and an amount of primary air to supply to the burner 34 is decreased, which causes the generation of nitrogen oxide. Although an increase of the combustion air temperature can be suppressed by shield of radiation heat with a partition plate or an insulating board, additional parts in the structure causes high cost.

An object of the present invention is to provide a water heater capable of suppressing an increase of combustion air temperature and suppressing to generate nitrogen oxide with an easy structure.

In order to achieve the above-described object, a first aspect of the invention is a water heater, in which a burner is an all primary air burner taking mostly required air in for combustion as primary air, where the sucked air is mostly primary air, and the burner is provided in a combustion chamber at a height that at least a part of a combustion part is protruded in a space covered by an mirror plate.

A second aspect of the invention, according to the first aspect, is a water heater in which the burner includes a cylindrical burner head as a combustion part and a side surface of the burner head is a combustion surface in order to efficiently transmit radiation heat to hot water in a hot water storage chamber.

A third aspect of the invention, according to the second aspect, is a water heater in which an exhaust passage communicated with a combustion chamber is provided in vertical direction being penetrating a center of a hot water storage chamber. In order to prevent increase of exhaust resistance and provide a burner at a suitable position, the burner is arranged at a position that an interval between an inner periphery of a lower surface of an mirror plate and an outer periphery of an upper end of a burner head in a radius direction of the burner head becomes equal to or more than an opening diameter of the exhaust passage.

According to the first aspect of the invention, radiation of a burner is efficiently transmitted to hot water in a hot water storage chamber, and radiation to portions other than the hot water storage chamber is decreased. Thus, an increase of the combustion air temperature can be suppressed, and generation of nitrogen oxide is rarely generated. Further, energy loss can be prevented, which improves thermal efficiency. Furthermore, since the height of a burner is only necessary for the water heater, additional parts of the structure such as an insulating board is not necessary, which reduces the cost.

According to the second aspect of the invention, in addition to the effect of the first aspect, a burner can be arranged closer to an end plate so that a whole periphery of a burner head faces the mirror plate. Thus, radiation heat can be efficiently transmitted to hot water in the hot water storage chamber.

According to the third aspect of the invention, in addition to the effect of the second aspect, a flowing passage of combustion gas for the burner head between the burner head and the mirror plate is secured to suppress increase of exhaust resistance, and the burner can be arranged at a suitable position.

BRIEF DESCRIPTION OF THE DRAWINGS

FIG. 2 are explanatory views of a lower mirror plate, where

DETAILED DESCRIPTION OF THE INVENTION

Embodiments of the present invention will be described below with reference to the drawings.

Figure 1:
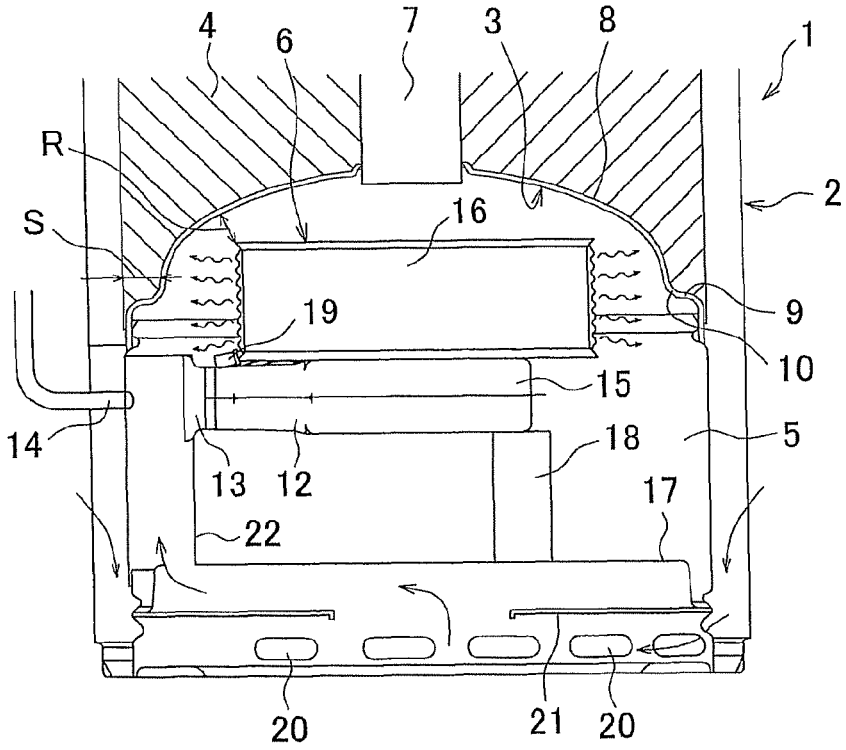
FIG. 1 is an explanatory view of a lower portion of a water heater.

FIG. 1 is an explanatory view of a lower portion showing an example of a water heater. A water heater 1 includes a hot water storage chamber 4 and a combustion chamber 5. The hot water storage chamber 4 is provided on an upper side of a cylindrical main body 2 and upper and lower parts of the hot water storage chamber 4 are closed with an upper mirror plate (not illustrated) and a lower mirror plate 3. The combustion chamber 5 has a burner 6 below the hot water storage chamber 4. In addition, the water heater 1 includes a water supply pipe and a hot water supply pipe on an upper side of the hot water storage chamber 4 (both pipes are not illustrated). The water supply pipe is for supplying water into the hot water storage chamber 4, and the hot water supply pipe is for taking hot water out of the hot water storage chamber 4.

The hot water storage chamber 4 includes an exhaust pipe 7 at a central axis thereof, and the exhaust pipe 7 penetrating the hot water storage chamber 4 to protrude above the main body 2. The exhaust pipe 7 can exhaust combustion gas generated in the combustion chamber 5 to the outside of the main body 2. The exhaust pipe 7 includes a baffle plate (not illustrated) having a spiral exhaust passage inside thereof.

Figure 2A:
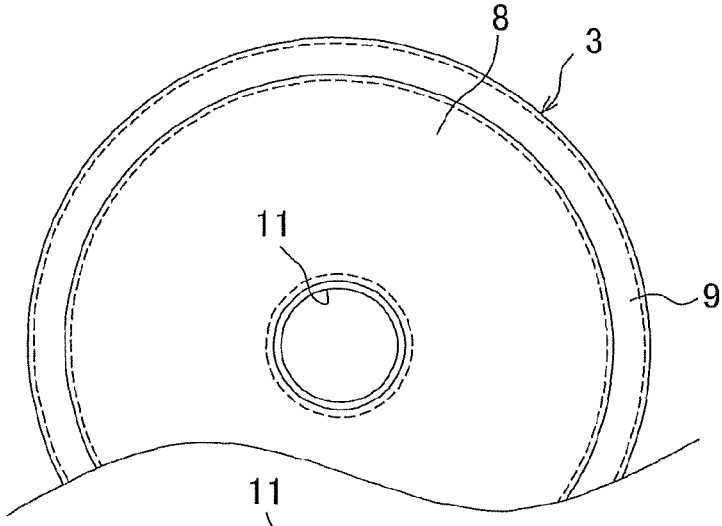
FIG. 2A illustrates a plane surface.
Figure 2B:
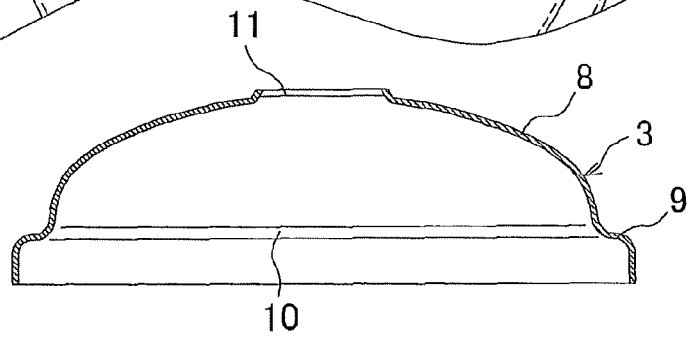
FIG. 2B illustrates a cross section.

The lower mirror plate 3 is a metal plate having a restriction part 8 protruding upwardly. As illustrated in FIG. 2, a second restriction part 9 having a shallower depth than the restriction part 8 is partially provided along a peripheral edge of the lower mirror plate 3. A protrusion part 10 protruding in a ring shape toward a center side of the lower mirror plate 3 is provided between the restriction part 8 and the second restriction part 9. A numeral 11 indicates a penetration hole of the exhaust pipe 7.

By providing the protrusion part 10, a ring-shaped hot water storage space S having relative thickness in a radius direction is provided at a lower end of the hot water storage chamber 4. By providing the hot water storage space S, a capacity in the hot water storage chamber 4 becomes larger than a conventional one and a large amount of hot water in a portion facing a burner head 16, which will be described later, can be kept.

On the other hand, the burner 6 is an all primary air burner taking in the most of air required for combustion as primary air. The burner 6 includes a burner main body 12 and a cylindrical burner head 16. The burner main body 12 has a throat part 13 facing a gas nozzle 14 whose forefront protrudes toward the inside of the combustion chamber 5. The cylindrical burner head 16 is a combustion part placed on a mixing chamber 15 at a forefront of the burner main body 12. The burner 1 6 is supported on a disk-like placing base 17 provided at a lower part of the combustion chamber 5 using a supporting plate 18 so as to position the burner head 16 at a center of the combustion chamber 5. The numeral 19 indicates a pilot burner. The burner head 16 has a plurality of burner ports on a substantially whole side surface thereof.

The burner 6 is supported by the supporting plate 18 such that the position of an upper end surface of the burner head 16 is located above the projection part 10 of the lower mirror plate 3. In other words, the burner head 16 is protruded into a space covered by the lower mirror plate 3. A side surface of the burner 6 faces a whole periphery of the hot water storage space S. However, if the burner head 16 is made too close to the lower mirror plate 3, a passage of combustion gas provided around the burner head 16 between the lower mirror plate 3 and the burner head 16 becomes narrow, resulting in an increase of exhaust resistance. Thus, it is desirable that the burner 16 is arranged at a position that an interval R between an inner periphery of a lower surface of the lower mirror plate 3 and an outer periphery of an upper end of the burner head 16 in the radius direction of the burner head 16 is always set to be equal to or larger than an opening diameter of the exhaust pipe 7.

Further, plural air feed ports 20, 20 and . . . for combustion air are provided at predetermined intervals in the peripheral direction at a lower peripheral edge of the placing base 17 to make inside of the placing base 17 communicate with the outside of the main body 2. The placing base 17 includes a partition plate 21 which has an opening center part at the inside thereof and separates the placing base 17 into upper and lower parts. On the other hand, while an upper space in the placing base 17 partitioned by the partition plate 21 is kept communicated with the throat part 13 of the burner main body 12, an air passage 22 in the vertical direction, which partitions the inside of the chamber combustion 5, is provided on a gas nozzle 14 side of the combustion chamber 5. Thus, after flowing into the placing base 17 from the air feed port 20 as indicated by an arrow, external air passes through an opening of the partition plate 21 and reaches to the air passage 22. Then, the air goes up into the air passage 22 to be capable of being introduced into the burner main body 12.

As for the water heater 1 having the above-described constitution, when an ignition knob of a controller (not illustrated) provided at an external of the main body 2 is pushed, a gas flow passage to a pilot burner 19 is opened so as to ignite the pilot burner 19. When the ignition is detected by a thermocouple (not illustrated), an electromagnetic valve of the gas flow passage is kept opened. Thus, when the ignition knob is operated in such a condition so as to open a main gas flow passage, the fuel gas is ejected from the gas nozzle 14 and supplied from the throat part 13 to the burner main body 12. By ejecting the fuel gas, air outside the main body 12 is then taken in to the burner main body 12 from the air feed port 20 through the inside of the placing base 17, the air passage 22, and the throat part 13. Then, the air is mixed with the fuel gas in the mixing chamber 15 and the mixed gas is supplied to the burner head 16. The mixed gas is ejected from the burner ports to be combusted. Therefore, combustion is carried out on the whole side surface of the burner head 16.

The high temperature combustion gas generated by combusting the burner 6 goes up along a lower surface of the lower mirror plate 3, passes through the exhaust pipe 7 at the center, and is exhausted outside of the main body 2. By the moving of the combustion gas, hot water in the hot water storage chamber 4 is heated by the lower mirror plate 3 and the exhaust pipe 7.

On the other hand, radiation heat generated by combusting at the side surface of the burner head 16 is radially radiated from the burner head 16 as illustrated with wavy arrows. However, since the whole side surface of the burner head 16 faces the hot water storage space S, the radiation heat is effectively transmitted to hot water in the hot water storage chamber 4 to heat the hot water.

Since the radiation heat is effectively transmitted to the hot water storage chamber 4, temperature of air below the burner 6 in the combustion chamber 5 does not become high. Thus, an increase of combustion air temperature from the air inlet 20 to the throat part 13 can be suppressed. Therefore, a volume of combustion air is not expanded, and a sufficient amount of primary air can be taken into the burner 6. Thus, generation of NOx can be suppressed.

According to the water heater 1 of the above-described embodiment, the burner 6 is an all primary air burner, that is arranged at the height that a part of the burner head 16 is protruded in a space covered by an lower mirror plate 3. Thus, radiation heat of the burner 6 is efficiently transmitted to hot water in the hot water storage chamber 4, and radiation emitted to the portions other than the hot water storage chamber 4 can be reduced. Therefore, an increase of combustion air temperature can be suppressed, and a generating amount of nitrogen oxide can be reduced. Further, energy loss can be reduced, and thermal efficiency can be improved. Furthermore, since setting of the height of the burner 6 is only necessary, the additional parts in the structure such as an insulating board are not necessary, and thus cost is reduced.

Particularly in this embodiment, the burner 6 includes a cylindrical burner head 16 as a combustion part, and the side surface of the burner head 16 is a combustion surface. Thus, the burner 6 can be placed closer to the lower mirror plate 3 to make a whole periphery of the burner head 16 to face the protrusion part 10, and thus radiation heat can be more efficiently transmitted to hot water in the hot water storage chamber 4.

Further, since the burner 6 is provided so that an interval R is always set to be equal to or larger than an opening diameter of the exhaust pipe 7, where the interval R is a distance between an inner periphery of a lower surface of the lower mirror plate 3 and an outer periphery of an upper end of the burner head 16 in the radius direction of the burner head 16. Thus, a flowing passage of combustion gas between the burner head 16 and the lower mirror plate 3 around the burner head 16 can be secured to suppress increase of exhaust resistance, and the burner 6 can be arranged at a suitable position.

Figure 3:
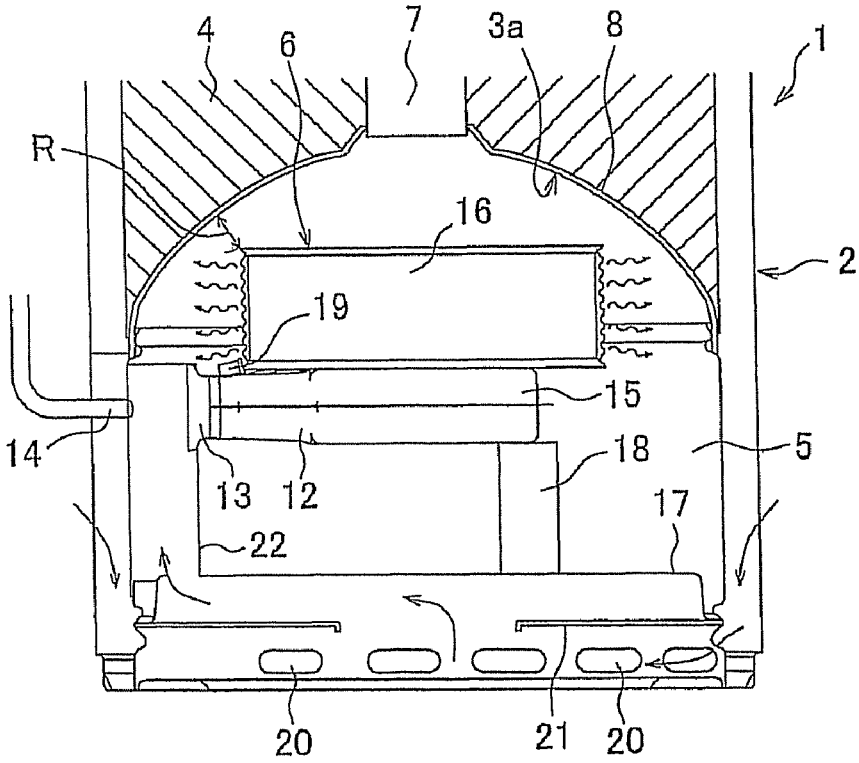
FIG. 3 is an explanatory view of a lower portion of a water heater of a modified example.
Figure 4:
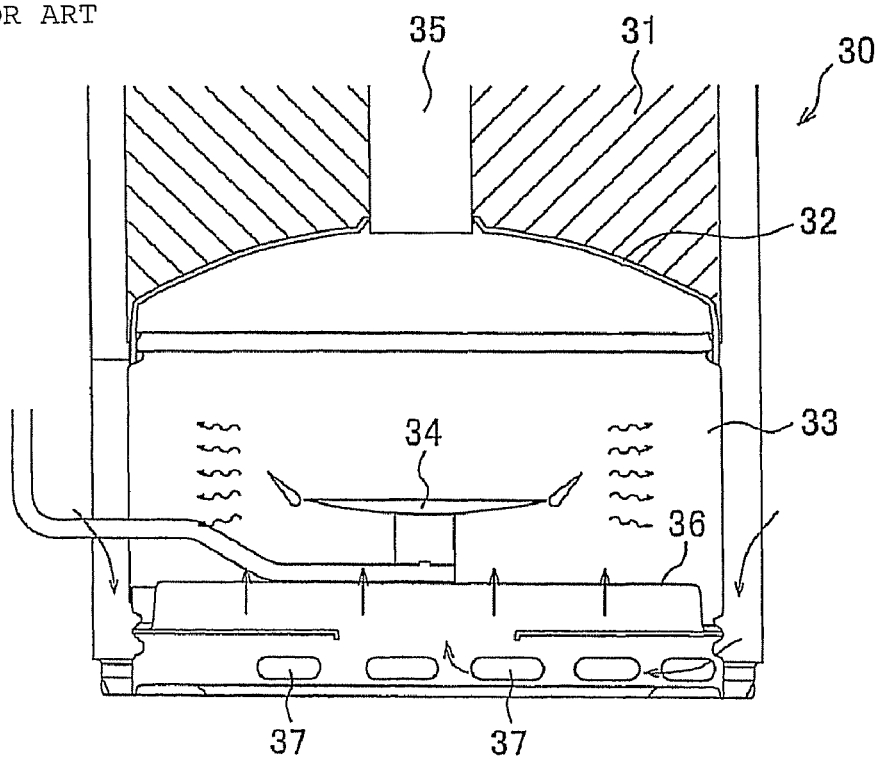
Fig. 4 PRIOR ART
FIG. 4 is an explanatory view of a lower portion of a conventional hot water storage type water heater.

In addition, the above-described embodiment is described by way of an example using a lower mirror plate provided with a protrusion part. However, as illustrated in FIG. 3, the present invention can be applied to a lower mirror plate 3*a* not having a protrusion part but merely having a deep restriction part 8. Of course, also in this case, it is desirable that the interval R between an inner periphery of a lower surface of the lower mirror plate 3*a* and an outer periphery of an upper end of the burner head 16 of the burner head 16 is made to be equal to or larger than an opening diameter of the exhaust pipe 7.

Further, a burner supporting structure is not limited to that in the above-described embodiment using the placing base and the supporting plate. The structure can be properly changed if the burner can be arranged so as to protrude into a space covered by a mirror plate. However, when an air passage is partitioned and formed in a combustion chamber like the above-described embodiment, an increase of combustion air temperature can be effectively suppressed.

On the other hand, a burner is not limited to the burner having a cylindrical burner head as a combustion part, and a burner can have burner ports on a peripheral surface of a plate-like burner head. Thus, the burner can be properly changed as long as it can be provided protruding into a space covered by a mirror plate. It can be acceptable for the burner that the whole part of the combustion part instead of a part of the combustion part is housed in the space.

Furthermore, combustion air can be compulsively supplied using a fan. A Bunsen burner can also be used depending on a size of a combustion chamber, a shape of a mirror plate, or the like.

What is claimed is:

1. A water heater comprising:

a cylindrical main body;

a hot water storage chamber arranged above a mirror plate having a restriction part protruding upwardly;

a combustion chamber having an all primary air burner and a burner throat opening provided below the mirror plate;

an air inlet that supplies combustion air to said burner provided at a lower part of the combustion chamber;

a placing base comprising a solid base support plate and a partition plate, the solid base support plate extending horizontally across the combustion chamber and provided between said burner and said air inlet;

the partition plate provided between the air inlet and the solid base support; and a supporting plate positioned above the solid base support and below the burner;

an air passage formed by a central opening in the partition plate and said base support and extending in a vertical, horizontal and then vertical flow direction;

wherein said burner is positioned in the combustion chamber at a height that protrudes and extends at least partially into a space covered and formed by the mirror plate, combustion air entering through said air inlet continuously flows through said air passage and is supplied to said burner throat of said burner, and the hot water in the hot water storage chamber is heated by combustion occurring in said combustion chamber.

2. The water heater according to claim 1, wherein said burner comprises a cylindrical burner head as a combustion part, and wherein a side surface of the cylindrical burner head forms a combustion surface.

3. The water heater according to claim 2, further comprising:

an exhaust passage in communication with the combustion chamber and extending upwardly through the center of the hot water storage chamber in a vertical direction;

wherein said burner is arranged at a position that an interval between an inner periphery of a lower surface of the mirror plate and an outer periphery of an upper end of the burner head in a radius direction of the burner head defines an imaginary concentrically shaped surface having an area that is equal to or greater than an opening area of the exhaust passage.

4. The water heater according to claim 1, wherein said burner comprises a burner main body, and wherein said solid base support is physically separate from said burner main body.

5. The water heater according to claim 1, wherein the partition plate is spaced away and physically separate from the air inlet.

6. The water heater according to claim 1, wherein the partition plate has a first diameter and the central opening in the partition plate has a second diameter, and wherein the second diameter is less than the first diameter.

* * * * *